US005996609A

United States Patent [19]

Akimoto et al.

[11] Patent Number: 5,996,609

[45] Date of Patent: Dec. 7, 1999

[54] PILOT-OPERATED DIRECTIONAL CONTROL VALVE

[75] Inventors: Takashi Akimoto; Masamichi Tajima, both of Ibaraki, Japan

[73] Assignee: SMC Corporation, Tokyo, Japan

[21] Appl. No.: 09/163,974

[22] Filed: Sep. 30, 1998

[30] Foreign Application Priority Data

Oct. 20, 1997 [JP] Japan ..... 9-304854

[51] Int. Cl.[6] ..... F15B 13/043

[52] U.S. Cl. ..... 137/270; 137/625.64

[58] Field of Search ..... 137/270, 625.64

[56] References Cited

U.S. PATENT DOCUMENTS

| | | | |
|---|---|---|---|
| 5,086,803 | 2/1992 | Nakajima | 137/270 |
| 5,273,074 | 12/1993 | Conradt et al. | 137/625.64 |
| 5,615,710 | 4/1997 | Sato | 137/625.64 |
| 5,860,445 | 1/1999 | Yoshimura et al. | 137/625.64 X |
| 5,868,157 | 2/1999 | Yoshimura et al. | 137/625.64 X |

FOREIGN PATENT DOCUMENTS

| | | |
|---|---|---|
| 2 257 837 | 8/1975 | France . |
| 1 127 675 | 4/1962 | Germany . |
| 64-17078 | 1/1989 | Japan . |
| 1-163270 | 11/1989 | Japan . |
| 1-174684 | 12/1989 | Japan . |

*Primary Examiner*—Gerald A. Michalsky

*Attorney, Agent, or Firm*—Oblon, Spivak, McClelland, Maier & Neustadt, P.C.

[57] ABSTRACT

An internal pilot channel branching from a supply port, an external pilot channel leading to an external pilot port, and a pilot input channel for guiding a pilot fluid to a pilot valve are opened in parallel on a channel-switching surface formed in a body. A channel-switching plate having a dent large enough to extend across the openings of two adjacent channels is mounted on the channel-switching surface in such a way that its direction can be changed by 180°.

4 Claims, 3 Drawing Sheets

PILOT-OPERATED DIRECTIONAL CONTROL VALVE

BACKGROUND OF THE INVENTION

1. Field of the Invention

The present invention relates to a pilot-operated directional control valve capable of changing between the internal and external pilot methods of introducing a pilot fluid.

2. Description of the Related

The pilot-operated directional control valve is a type of directional control valve used for switching the flow of a pressurized fluid such as compressed air. A pilot-operated directional control valve is composed of a main valve and a pilot valve, and switches a valve disc in the main valve by allowing a pilot fluid supplied from the pilot valve to act on the valve disc.

Such pilot-operated directional control valves are classified into internal and external pilot types depending on the method used to supply pilot fluid. Of the two, internal pilot-operated directional control valves guide part of a main fluid from a supply port in the main valve to the pilot valve; this fluid functions as the pilot fluid. External pilot-operated directional control valves, on the other hand, guide an exclusive pilot fluid (i.e., one distinct from the main fluid) to the pilot valve through an external pipe connected an external pilot port. The type of valve used will depend on the working conditions, so changes in working conditions often require changes between the internal and external pilot types.

To deal with this situation, directional control valves have been proposed that include a directional control mechanism for switching between the internal pilot type and the external pilot type.

As typically described in Japanese Utility Model Laid Open No. 64-17078, the directional control mechanism is composed of a plurality of parts and is integrated into a mounting hole of a complex shape formed in a valve body. As a result, such conventional directional control valves have a complex overall structure and require substantial time and labor for manufacturing or assembly. They are also costly. In addition, the individual parts, the mounting hole, and/or the channel opened in the mounting hole of these valves are all relatively cumbersome to process.

SUMMARY OF THE INVENTION

This invention is intended to provide a pilot-operated directional control valve of a simple structure that can change between the internal and external pilot types.

To achieve this objective, this invention provides a pilot-operated directional control valve comprising an internal pilot channel branching from one of the ports in a main valve; an external pilot channel leading to an external pilot port; a pilot input channel for guiding a pilot fluid to a pilot valve; a channel-switching surface formed in one surface of a valve body and into which the channels are each opened in parallel in the horizontal direction; and a channel-switching plate mounted on the channel-switching surface in such a way that its direction can be changed.

The above-mentioned channel-switching plate has on its surface contacting the channel-switching surface, a dent large enough to extend across the openings of the two adjacent channels to allow the pilot input channel to be selectively connected to the internal or external pilot channel by changing the direction of the channel-switching plate and thus the locational relationship between the dent and each opening.

Thus, this invention simply opens the pilot input channel and the internal and external pilot channels into the channel-switching surface and mounts onto the channel-switching surface the single channel-switching plate with the dent, so its configuration is very simple, as are the as sociated processing and assembly operations.

According to a specific embodiment of this invention, the valve body of the main valve has a rectangular mounting hole, and the flat bottom surface of the mounting hole forms the channel-switching surface. A rectangular channel-switching plate, the thickness of which is substantially the same as the depth of the mounting hole, is mounted in this mounting hole.

According to this invention, the channels are preferably provided in parallel in the direction of the horizontal width of the valve body, and the channel-switching plate is mounted so that its direction can be changed by 180° in the direction of the horizontal width of the valve body.

According to this invention, an amplifying valve that is switched by the pilot valve to supply or discharge a pilot fluid to or from the main valve can be provided between the main valve and the pilot valve.

DETAILED DESCRIPTION OF THE PREFERRED EMBODIMENTS

Figure 1:
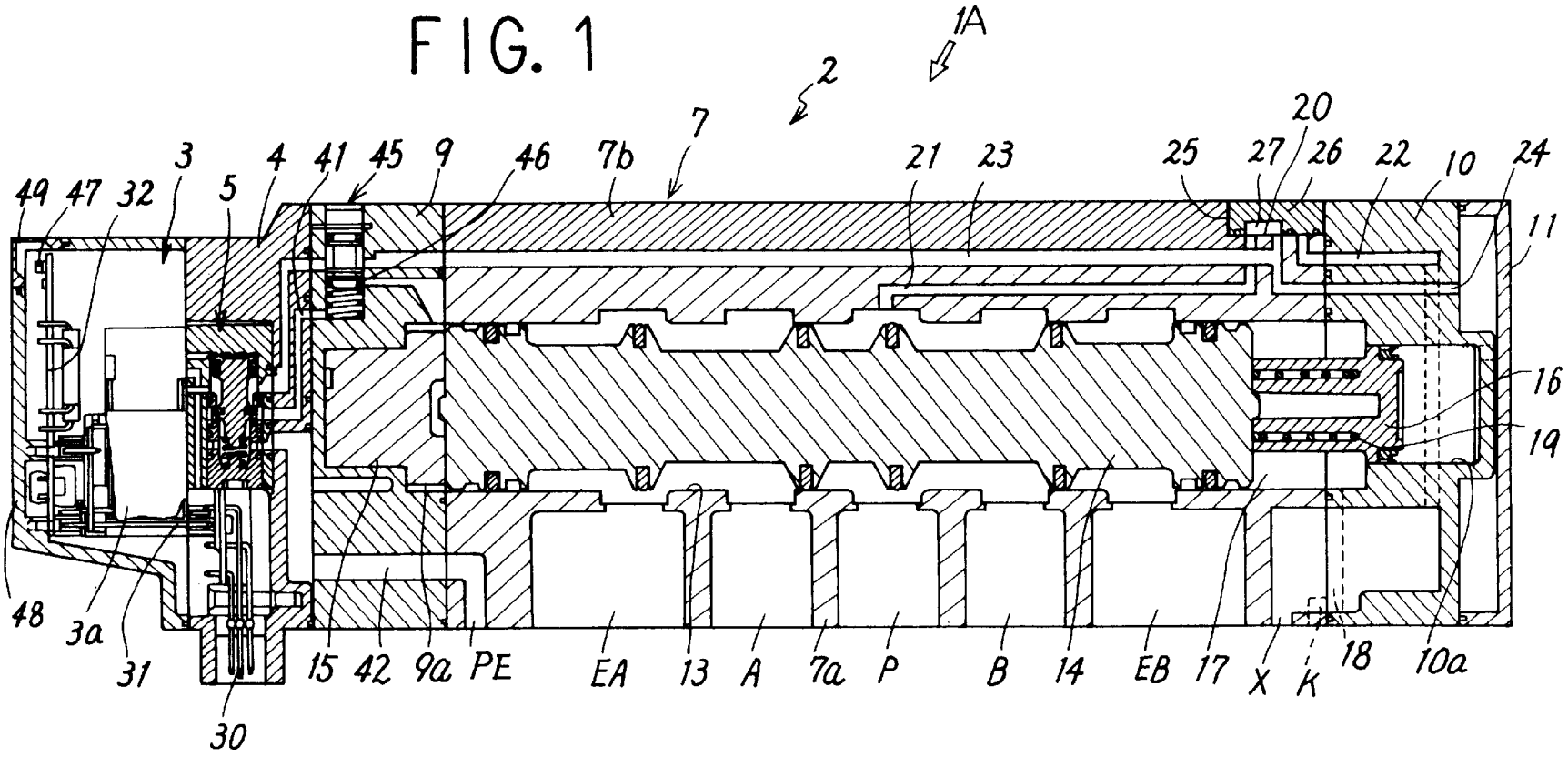
FIG. 1 is a vertically sectional front view showing a first embodiment of a directional control valve according to this invention.

FIGS. 1 and/or 3 show a first embodiment of a pilot-operated directional control valve according to this invention. This directional control valve 1A is of a single pilot type and comprises a main valve 2 that switches a channel for a main fluid, a pilot valve 3 driven by a solenoid 3*a*, and an amplifying valve 5 assembled into an adapter plate 4 between the main valve 2 and the pilot valve 3.

The main valve 2 comprises a valve body 7 shaped like a long rectangular parallelepiped, a first and a second blocks 9 and 10 mounted on the respective axial sides of the valve body 7, and a cover 11 mounted on the outer surface of the second block 10. The valve body 7 is composed of a first portion 7*a* occupying most of the valve body and a second portion 7*b* mounted on the top surface of the first portion 7*a* using screws.

The valve body 7 includes a pressure fluid supply port P provided at the center of the bottom surface of the first portion 7*a*; a first and a second output ports A and B provided on the respective sides of the supply port P at an almost equal interval therefrom; a first and a second ejection ports EA and EB provided on the respective sides of the output ports A and B at an almost equal interval from the respective output ports; and a valve hole 13 into which these ports are opened. A valve disc 14 that switches the channel between the outputs ports A, B and the supply port P and ejection ports EA, EB is slidably inserted into the valve hole 13.

In addition, an external pilot port X and a breathing port K are opened in the direction of the second block 10, and a pilot ejection port PE that ejects a pilot fluid to the exterior is opened in the direction of the first block 9.

A pressure chamber 9*a* having almost the same diameter as the valve hole 13 is formed in first block 9, and a cushion 15 is inserted into the pressure chamber 9*a*. The cushion 15 is formed of an elastic body such as urethane resin to reduce any impact effected when the valve disc 14 returns to its original position.

In addition, a return piston chamber 10*a* having a smaller diameter than the valve hole 13 is formed in the second block 10, and a return piston 16 is slidably inserted into the return piston chamber 10*a* in an airtight manner.

A breathing chamber 17 formed between the return piston 16 and the valve disc 14 is in communication with a port-K through a breathing channel 18, and a return spring 19 that presses the valve disc 14 toward the pressure chamber 9*a* is compressively installed in the breathing chamber 17.

A rectangular mounting hole 25 that is drilled down to a specified depth from the top surface of the valve body 7 is formed in this surface near the second block 10. The bottom surface of the mounting hole 25 is a flat channel-switching surface 20, and an internal pilot channel 21 branching from the supply port P; an external pilot channel 22 in communication with the external pilot port X; a pilot input channel 23 in communication with a pilot inlet port p in the pilot valve 3 are all opened in this channel-switching surface 20 in parallel at equal intervals.

Figure 2A:
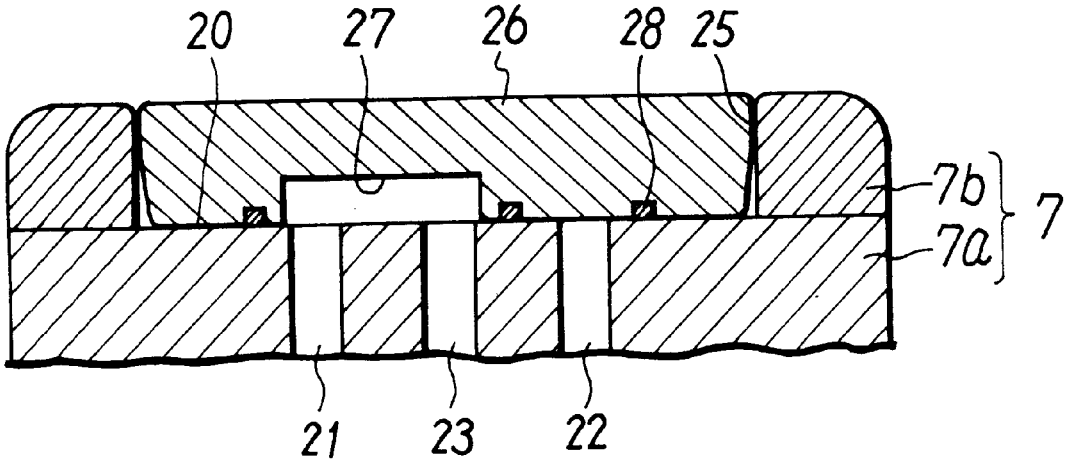
FIGS. 2A and 2B are enlarged sectional views showing that the direction of a channel-switching plate is changed.
Figure 2B:
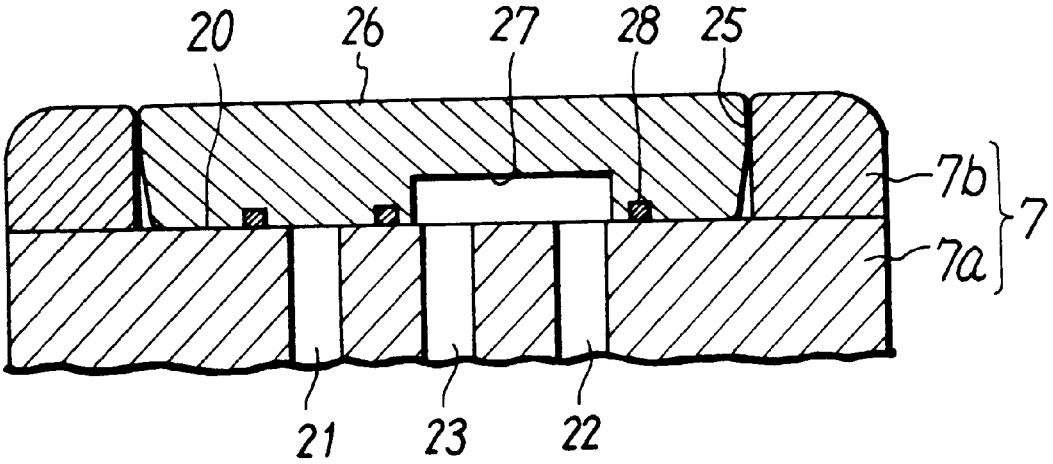
Figure 4:
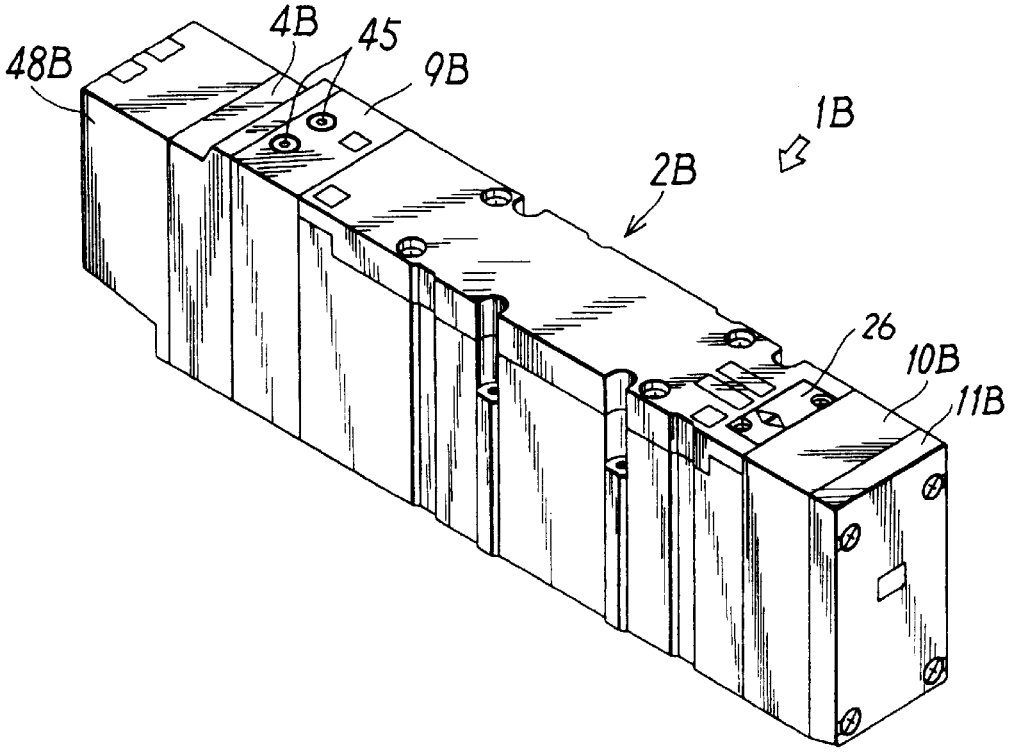
FIG. 4 is an oblique view showing a second embodiment of a directional control valve according to this invention.

A rectangular channel-switching plate 26 having a thickness substantially the same as the depth of the mounting hole 25 is detachably mounted in the mounting hole 25 using mounting screws (see FIG. 4). The channel-switching plate 26 can have its direction changed by 180° and has in its bottom surface contacting the channel-switching surface 20, a dent 27 extending across the center of the bottom surface and two openings adjacent to the center. As shown in FIGS. 2A and 2B, by changing the direction of the channel-switching plate 26 by 180°, the dent 27 can be used to selectively connect the pilot input channel 23 at the center to either the internal or external pilot channel 21 or 22 located on the respective sides of the channel 23. In addition, annular seal members 28 are mounted on a portion of the bottom surface of the channel-switching plate 26 that encompasses the dent 27 and a portion of this surface facing the channel that is not connected to the pilot input channel 23.

Although FIG. 1 shows that the openings of the channels 21, 22, and 23 are provided in parallel in the axial direction of the valve body 7, they are actually provided in parallel along the horizontal axis of the valve body 7, as seen in FIG. 4. Thus, the dent 27 in the channel-switching plate 26 is reasonably formed in the corresponding direction.

Figure 3:
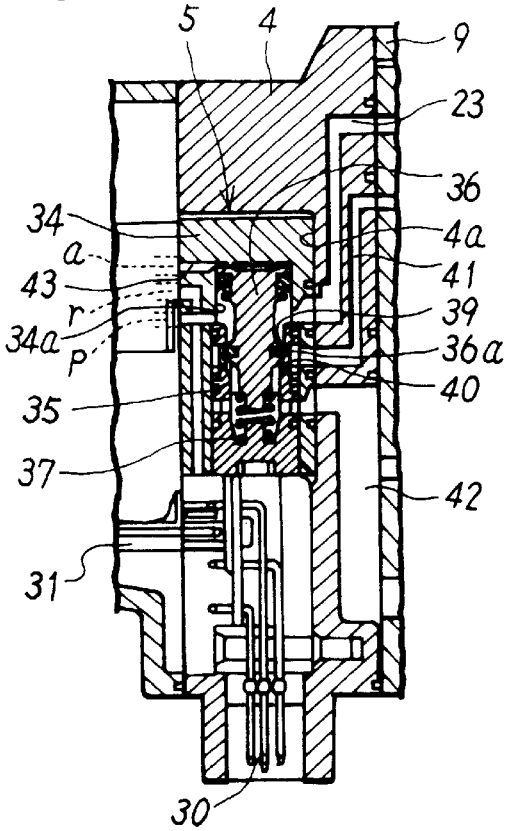
FIG. 3 is an enlarged sectional view showing the structure of an amplifying valve.

The pilot valve 3 is configured as a three-port electromagnetic valve, and comprises a pilot inlet port p, a pilot outlet port a, and a pilot ejection port r (for the ports p, a, and r, see FIG. 3). The solenoid 3*a* is magnetized and demagnetized to switch the pilot output port a between the pilot inlet port p and the pilot ejection port r for communication.

In terms of communication, the pilot inlet port p is in communication with the pilot input channel 23 via the amplifying valve 5 as described above; the pilot output port a, with a pressure chamber 43 in the amplifying valve 5; and the pilot ejection port r, with the pilot ejection port PE through a pilot ejection channel 42.

In addition, the solenoid 3*a* is supplied with power from a feeding plug 30 provided in the adapter plate 4, via an electric connector 31 and a printed circuit board 32 provided under the pilot valve 3 and on one side thereof, respectively.

The amplifying valve 5, which is shown in FIG. 3 in detail, comprises an amplifying valve body 34 mounted in a mounting chamber 4*a* formed in the adapter plate 4; a valve seat member 35 mounted in an airtight manner in a sliding hole 34*a* located in the axial direction of the valve body 34; an amplifying valve disc 36 that slides through the sliding hole 34*a* in an airtight manner; and a return spring 37 that returns the amplifying valve disc 36 to its original position.

An output valve seat 39 and an ejection valve seat 40 are formed opposite in the valve seat member 35. The space between the valve seats is in communication with the pressure chamber 9*a* through the pilot output channel 41. In addition, the pilot input channel 23 is opened in the space in the sliding hole 34*a* located above the output valve seat 39, the space below the ejection valve seat 40 is in communication with the pilot ejection channel PE through the pilot ejection channel 42, and the pressure chamber 43 between the amplifying valve body 34 and the amplifying valve disc 36 is in communication with the pilot output port a.

The amplifying valve disc 36 includes a valve disc 36*a* that opens and closes the output and ejection valve seats 39 and 40 by means of sliding.

A manually operated device 45 that enables a manual operation for allowing the pilot input channel 23 to communicate directly with the pressure chamber 9*a* without using the amplifying valve 5 or the pilot valve 3 is provided in the first block 9, and is configured in such a way that the device can be pressed downward, as seen in the figure. The manually operated device 45 is normally moved upward in the figure, due to the urging force of the return spring 46, to allow the pilot input channel 23 to communicate with the pilot inlet port p, and when pressed, allows the pilot input channel 23 to communicate directly with the pressure chamber 9*a*.

Thus, when the pilot valve 3 cannot be operated by the solenoid 3*a* due to an accident such as a service interruption or during a test operation, the manually operated device 45 can be pressed and released to drive the valve disc 14.

Reference numeral 47 in FIG. 1 is an indicator lamp indicating that power is being supplied to the solenoid 3*a* mounted on the printed circuit board 32, and a transparent or semi-transparent indicating window 49 through which the operator visually checks whether the indicator lamp 47 is lit is provided in a circuit board cover 48 covering the pilot valve 3 and the printed circuit board 32.

FIGS. 1 and 2A show that the directional control valve 1A acts as the internal pilot type when mounted in the direction in which the dent 27 operates to connect the pilot input channel 23 and the internal pilot channel 21 together. Thus, a pilot fluid is supplied to the pilot valve 3 and the amplifying valve 5 from the supply port P through the internal pilot channel 21 and the pilot input channel 23.

FIG. 1 shows that the solenoid 3*a* is demagnetized. Since the pilot outlet port a in the pilot valve 3 is in communication with the pilot ejection port r and the amplifying valve disc 36 is moved upward in the figure by the urging force of the return spring 37, the amplifying valve disc 36*a* closes the output valve seat 39 while opening the ejection valve seat 40.

Thus, the pilot fluid in the pressure chamber 9*a* is ejected from the pilot ejection port PE through the pilot output channel 41, the ejection valve seat 40, and the pilot ejection channel 42. The valve disc 14 is moved leftward in the figure by the impelling force of compressed air supplied to the return piston chamber 10*a* through the return channel 24 and the urging force of the return spring 19, thereby allowing the supply port P to communicate with the second output port B while allowing the first output port A to communicate with the first ejection port EA.

When the solenoid 3*a* is magnetized, the pilot inlet port p and pilot output port a in the pilot valve 3 mutually communicate to supply a pilot fluid to the pressure chamber 43 in the amplifying valve 5. Then, the amplifying valve disc 36 moves downward to cause the amplifying valve disc 36*a* to open the output valve seat 39 while closing the ejection valve seat 40, thereby supplying an internal pilot fluid to the pressure chamber 9*a*.

Thus, the difference in diameter between the valve disc 14 and the return piston 16 causes the valve disc 14 to move rightward in the figure, thereby allowing the supply port P to communicate with the first output port A while allowing the second output port B to communicate with the second ejection port EB.

When the solenoid 3*a* is demagnetized, the pilot output port a communicates with the pilot ejection port r to eject the pilot fluid supplied to the pressure chamber 43 in the amplifying valve 5, from the pilot ejection port PE to the exterior through the pilot ejection channel 42. Then, the urging force of the return spring 46 causes the amplifying valve disc 36 to move upward in the figure, thereby allowing the amplifying valve disc 36*a* to close the output valve seat 39 while opening the ejection valve seat 40.

Thus, the internal pilot fluid supplied to the pressure chamber 9*a* is ejected from the pilot ejection port PE to the exterior through the pilot output channel 41, the ejection valve seat 40, and the pilot ejection channel 42. A combination of two forces, the impelling force of compressed air supplied to the return piston chamber 10*a* and the urging force of the return spring 19, then causes the valve disc 14 to return to its original position, thereby allowing the supply port P to communicate with the output port B while allowing the first output port A to communicate with the first ejection port EA.

In this case, the cushion 15 provided in the pressure chamber 9*a* reduces any impact effected when the valve disc 14 returns to its original position.

When the channel-switching plate 26 is inverted by 180° and mounted in the direction shown in FIG. 2B, the directional control valve is changed to the external pilot type. In this case, the dent 27 allows the pilot input channel 23 to communicate with the external pilot channel 22, thereby causing a pilot fluid to be supplied to the pilot valve 3 and the amplifying valve 5 from the external pilot port X through the pilot input channel 23.

The directional control valve 1A according to the first embodiment is constructed by simply opening the pilot input channel 23, the internal pilot channel 21, and the external pilot channel 22 in parallel on the channel-switching surface 20 provided in the valve body 7 and mounting on the channel-switching surface 20 the single channel-switching plate 26 with the dent 27 extending across the two openings in such a way that the direction of the plate can be changed. Thus, this embodiment requires a smaller number of parts than conventional products and has a very simple structure. In addition, it is easy to process each part and to form the mounting hole and channels in the valve body 7; assembly is straightforward. Furthermore, the switching operation is easily accomplished because it can be performed in a relatively large space on the top-surface side of the main valve 2.

Furthermore, due to the presence of the amplifying valve 5, this embodiment requires only small output of pilot fluid from the pilot valve 3 to drive the amplifying valve body 36, which has a much smaller diameter than the valve disc 14 of the main valve 2, thereby reducing the size and cost of the pilot valve 3 driven by the solenoid 3*a*.

FIG. 4 shows a second embodiment. A directional control valve 1B according to the second embodiment appears very similar to the directional control valve 1A according to the first embodiment, but is of a double-solenoid type and differs from the first embodiment in that a main valve is switched by two pilot valves. That is, in FIG. 4, a pressure chamber that is similar to the pressure chamber provided in the first block 9 in the first embodiment is formed in a first and a second blocks 9B and 10B on the respective sides of a main valve 2B, and a pilot fluid is supplied to and ejected from these pressure chambers to switch the valve disc. Two pilot valves are integrated inside a cover 48B, two amplifying valves are integrated inside an adapter plate 4B, and two manually operated devices 45 are integrated inside the first block 9B.

The second embodiment uses substantially the same switching mechanism as in the first embodiment to switch between the internal pilot type and the external pilot type.

The directional control valves according to the above embodiments are all of a five-port type, but this invention is not limited to this type buff may be of a four- or three-port type.

What is claimed is:

1. A pilot-operated directional control valve comprising:

a main valve having a plurality of ports, a valve hole with which each of the ports communicates, and a valve disc slidably provided in the valve hole to switch channels; and at least one pilot valve that supplies a pilot fluid to the main valve to drive said valve disc;

wherein said main valve includes an internal pilot channel branching from one of said ports; an external pilot channel leading to an external pilot port; a pilot input channel for guiding a pilot fluid to a pilot valve; a channel-switching surface formed in one surface of a valve body and into which said channels are each opened in parallel in the horizontal direction; and a channel-switching plate mounted on the channel-switching surface in such a way that its direction can be changed;

wherein said channel-switching plate has on its bottom surface contacting said channel-switching surface, a dent large enough to extend across the openings of the two adjacent channels to allow said pilot input channel to be selectively connected to the internal or external pilot channel by changing the direction of the channel-switching plate and thus the locational relationship between the dent and each opening;

wherein the valve body of said main body has a rectangular mounting hole of a specified depth;

wherein a flat bottom surface of the mounting hole forms said channel-switching surface; and wherein said channel-switching plate, which is rectangular and of a thickness substantially equal to the depth of the mounting hole, is mounted in this mounting hole.

2. A directional control valve according to claim 1 wherein the openings of said channels are provided in parallel in the direction of the horizontal width of the valve body, and wherein the direction of said channel-switching plate can be changed by 180° in the direction of the horizontal width of the valve body.

3. A directional control valve according to claim 1 wherein an amplifying valve that is switched by the pilot valve to supply or discharge a pilot fluid to or from said main valve can be provided between said main valve and said pilot valve.

4. A directional control valve according to claim 1 wherein the external pilot and the internal pilot channel selectively connect with the pilot input channel which communicates with two pilot pressure chambers.

* * * * *